US007124877B2

(12) United States Patent
Honegger

(10) Patent No.: US 7,124,877 B2
(45) Date of Patent: Oct. 24, 2006

(54) METHOD AND DEVICE FOR THE CONVERSION OF A CONVEYED STREAM OF FLAT ARTICLES

(75) Inventor: Werner Honegger, Bäch (CH)

(73) Assignee: Ferag AG, Hinwil (CH)

( * ) Notice: Subject to any disclaimer, the term of this patent is extended or adjusted under 35 U.S.C. 154(b) by 207 days.

(21) Appl. No.: 10/965,995

(22) Filed: Oct. 15, 2004

(65) Prior Publication Data

US 2005/0093225 A1 May 5, 2005

(30) Foreign Application Priority Data

Oct. 31, 2003 (CH) ..... 1862/03

(51) Int. Cl.
*B65G 29/00* (2006.01)

(52) U.S. Cl. ..... 198/608; 198/626.1; 198/435; 271/177; 271/184; 271/69

(58) Field of Classification Search ..... 198/608, 198/626.1; 271/177, 184
See application file for complete search history.

(56) References Cited

U.S. PATENT DOCUMENTS

| | | | | |
|---|---|---|---|---|
| 1,760,030 | A | 5/1930 | Alger | |
| 5,324,025 | A | 6/1994 | Chadwick et al. | |
| 5,462,268 | A * | 10/1995 | Remy et al. | 271/225 |
| 5,583,663 | A * | 12/1996 | Boeve | 358/487 |
| 5,897,291 | A * | 4/1999 | Gerwe et al. | 414/790.7 |

FOREIGN PATENT DOCUMENTS

EP 0 681 979 A1 2/1995

EP 0 841 643 A1 5/1998

OTHER PUBLICATIONS

WO 03/78080 A1, Method and Device for Presorting Loose and Scanned Flat Postal Articles Provided with Distributing Information, Publication Date Sep. 25, 2003.
WO 03/053831 A1, Method and Device for Forming Groups of Flat Articles, Publication Date: Jul. 3, 2003.

* cited by examiner

*Primary Examiner*—Joe Dillon, Jr.
(74) *Attorney, Agent, or Firm*—Rankin, Hill, Porter & Clark LLP

(57) ABSTRACT

For converting a stream of flat articles from transverse conveyance to parallel conveyance, two continuously operated conveyors are provided, a transverse conveyor having a direction (FQ) of transverse conveyance and serving as supplying conveyor and a parallel conveyor having a direction (FP) of parallel conveyance and serving as removing conveyor. The direction (FQ) of transverse conveyance and the direction (FP) of parallel conveyance encompass an angle. The articles are pushed one after the other out of an outlet of the supplying conveyor towards an entrance of the removing conveyor. Before a trailing zone of the article has left the supplying conveyor, a leading zone of the article is grasped by an alignment device and is conveyed onwards with the speed of the parallel conveyor in the direction (FP) of parallel conveyance and is thereby aligned to the entrance of the removing conveyor, while the trailing zone is bent between the alignment device and the outlet of the supplying conveyor. The stream conversion can also be operated in the reverse sense and again with continuously operated conveyors and nonetheless the articles are at all times during conversion safely guided.

14 Claims, 8 Drawing Sheets

METHOD AND DEVICE FOR THE CONVERSION OF A CONVEYED STREAM OF FLAT ARTICLES

BACKGROUND OF THE INVENTION

The invention is situated in the field of materials handling technology and concerns a method and a device which serve for the conversion of a stream of flat articles being bendable to at least a limited degree, wherein the articles, prior to the conversion, are aligned essentially transverse to the conveying direction and, following the conversion, parallel to it or wherein the articles, prior to the conversion, are aligned parallel to the conveying direction and, following the conversion, transverse to it and wherein the flat articles, when aligned parallel to the conveying direction, are conveyed one after the other, i.e., not overlapping one another. The flat articles are in particular rectangular or square shaped; they are, for example, printed products or stack-shaped groups of component parts of multi-page printed products.

In a stream in which flat articles are arranged parallel to the conveying direction and one behind the other, significantly higher conveying speeds are necessary to achieve equivalent conveying capacities than is the case for a stream, in which the articles are arranged transverse to the conveying direction. Therefore, it is a concern of materials handling technology to convey the flat articles, whenever possible, with an alignment transverse to the conveying direction or parallel to the conveying direction and overlapping one another. Such concern acquires more importance the higher conveying capacities become. However, it is frequently necessary, in particular for processing steps to be carried out on continuously conveyed articles, to align the articles one behind the other and parallel to the conveying direction. If for such cases conveyance in parallel and one behind the other is to be restricted to a necessary minimum, the article stream needs to be converted in the manner described above.

The mentioned stream conversions are known to be implemented, for example, by redirecting the articles by 90°, the redirection being carried out together with a transfer from a supplying conveyor to a removing conveyor. For keeping the devices required for such conversion within a tolerable limit and for still being able to move the articles in a controlled manner during transfer and redirection, usually two conveyors are used, one of which (in most cases the supplying conveyor) is operated alternatingly. If two continuously operating conveyors are used, an at least partially uncontrolled article movement during the transfer is to be accepted.

Publication U.S. Pat. No. 1,760,030 describes a transfer of glue-bound books from a binding machine to a drying machine, wherein the books are conveyed one behind the other and parallel to a first conveying direction in the binding machine and transverse to a second conveying direction in the drying machine, wherein the two conveying directions are essentially horizontal and encompass an angle of 90°, and wherein the outlet from the binding machine is located above the entrance to the drying machine. For the deviation, the books are released from holding means of the binding machine in order to drop into conveying compartments of the drying machine in an uncontrolled manner.

BRIEF SUMMARY OF THE INVENTION

It is the objective of the invention to create a method and a device to be used for stream conversions as mentioned above, wherein the method and the device are to make it possible to implement the stream conversions with continuously operating conveying means but to move the articles in a held manner during the whole conversion and to nonetheless use simple means only.

According to the invention, a continuously operating transverse conveyor having a direction of transverse conveyance is used for transverse conveyance, i.e. for conveyance with the articles being arranged transverse to the conveying direction. The transverse conveyor comprises e.g. a plurality of circulating conveying compartments being arranged essentially transverse to the direction of transverse conveyance, the flat articles being held in the compartments, for example, by gravity. Such a transverse conveyor comprises a plurality of outlets or entrances respectively, which move in the direction and with the speed of transverse conveyance. Auxiliary conveying means assigned to the transverse conveyor are e.g. arranged inside the conveying compartments and serve for displacing an article transverse to the direction of transverse conveyance while being transported by the transverse conveyor in the direction of transverse conveyance.

For conveying the articles arranged parallel to the conveying direction and one behind the other (parallel conveyance), a continuously driven parallel conveyor with a direction and a speed of parallel conveyance is utilised, for example, a pair of conveyor belts, between which the articles are clamped. Such a parallel conveyor comprises one stationary entrance or stationary outlet respectively.

The transverse conveyor and the parallel conveyor are both operated continuously and with the same conveying cycle (same conveying capacity). The direction of transverse conveyance and the direction of parallel conveyance are matched to one another in such a manner, that in parallel conveyance, there is a pre-defined distance between successive articles. Depending on the direction of the stream conversion (transverse conveyance to parallel conveyance or parallel conveyance to transverse conveyance), the transverse conveyor is the supplying conveyor or the removing conveyor or the parallel conveyor is the removing conveyor or the supplying conveyor respectively. In every conveying cycle there is a moment, in which an outlet or entrance of the transverse conveyor is aligned with the entrance or outlet of the parallel conveyor.

The transverse conveyor, the auxiliary conveying means and the parallel conveyor are arranged in such a manner, that the conveying direction of the auxiliary conveying means is aligned parallel to the direction of parallel conveyance and that the direction of transverse conveyance encompasses an angle of, for example, 90° with the direction of parallel conveyance. During stream conversion, the auxiliary conveying means accelerates each article in the direction of parallel conveyance from standstill to the speed of parallel conveyance or decelerates it correspondingly.

An alignment means is provided between the transverse conveyor and the parallel conveyor, the alignment means being aligned with the entrance of the removing conveyor and being equipped for grasping and moving articles during stream conversion in such a manner, that their leading edge is precisely aligned with the entrance of the removing conveyor and their trailing portion is bent transverse to their moving direction between the outlet of the supplying conveyor and the alignment means. For stream conversion from transverse conveyance to parallel conveyance, the alignment means is stationary and is aligned with the stationary entrance of the parallel conveyor. For stream conversion from parallel conveyance to transverse conveyance, a single means of alignment may be provided, which, in each conveying cycle, accompanies one entrance of the transverse conveyor in the direction of transverse conveyance and returns to its starting point (alternating alignment means). It is also possible to provide a plurality of correspondingly circulating alignment means or to provide one alignment means at every entrance of the transverse conveyor.

The alignment means, for example, comprises a pair of alignment rollers being driven to rotate in opposite directions and having, in a part of their circumference a constant maximum radius and in the remaining part of the circumference a smaller radius. The rotation axes of the alignment rollers are aligned parallel to one another and perpendicular to the direction of parallel conveyance. The driving speed of the alignment rollers is such, that their surface speed in the zone of the maximum radius is essentially the same as the speed of parallel conveyance and that the zones of the maximum radius of both rollers are facing each other in synchronism with the conveying cycle of the transverse and the parallel conveyor. In this holding configuration the alignment rollers hold an article positioned between them and move it with the speed of parallel conveyance.

The distances between the entrance or outlet of the parallel conveyor and the alignment means and the distance between the outlet or entrance of the transverse conveyor currently participating in the stream conversion and the alignment means are as small as possible and always such that, during conversion, every article is always simultaneously held either by the supplying conveyor and the alignment means or by the alignment means and the removing conveyor. This means that during the whole of the conversion, the articles are safely guided, although the supply and the removing conveyor are operated continuously and in different directions. The above mentioned distances are to be adapted to the flexibility or bendability respectively of the articles and to their expanse in the direction of parallel conveyance.

BRIEF DESCRIPTION OF THE SEVERAL VIEWS OF THE DRAWINGS

Exemplary embodiments of the invention are described in detail in conjunction with the following Figs., wherein.

DETAILED DESCRIPTION OF THE INVENTION

Figure 1:
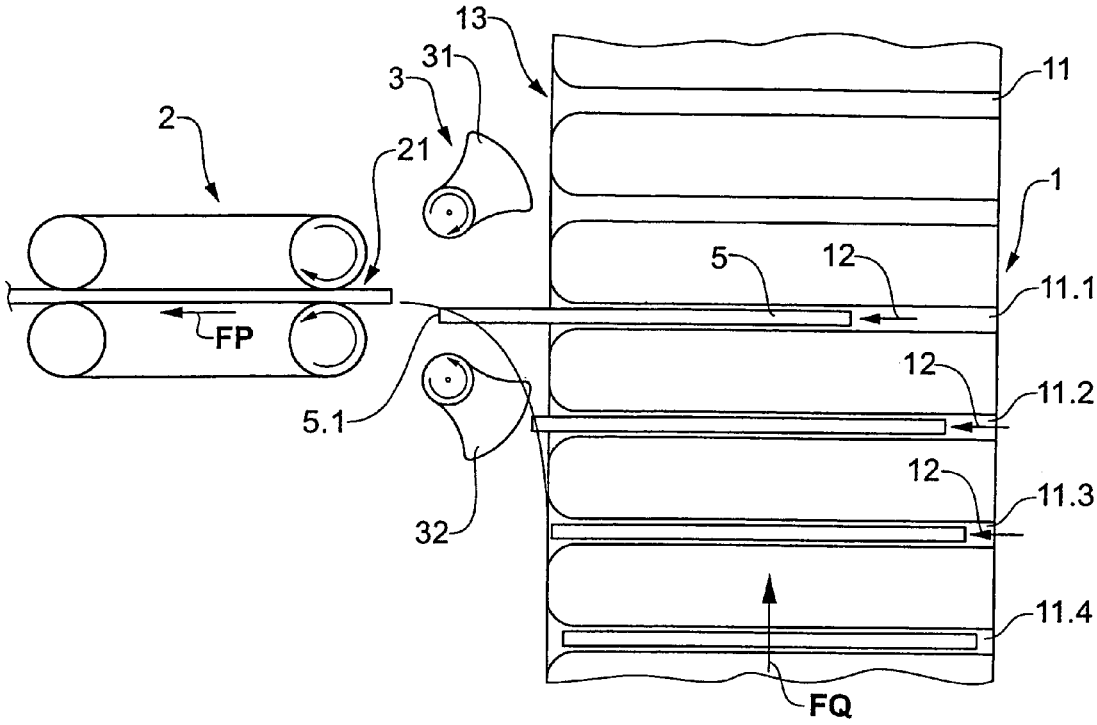
FIGS. 1 to 4 show top views of a stream conversion from transverse to parallel conveyance according to the invention.

FIGS. 1 to 4 illustrate an exemplary embodiment of the method according to the invention on the basis of a very schematically depicted embodiment of the device according to the invention. The illustrated method is a stream conversion from transverse conveyance to parallel conveyance. The illustrated device comprises a transverse conveyor 1 as supplying conveyor with a direction FQ of transverse conveyance. The transverse conveyor 1 comprises a row of conveying compartments 11 having lateral outlets 13 and being aligned transverse to the direction FQ of transverse conveyance. The device further comprises a parallel conveyor 2 as removing conveyor, having a direction FP of parallel conveyance and being, for example, a stationary pair of band conveyors with a stationary entrance 21 or a simple conveyor belt. Between the transverse conveyor 1 and the parallel conveyor 2 a stationary alignment means 3 is oriented towards the entrance 21 of the parallel conveyor 2. The alignment means 3 comprises two alignment rollers 31 and 32 of the form already described further above. An auxiliary conveying means (not shown) is assigned to each compartment 11 of the transverse conveyor 1, for example, a slider whose effect on the articles within the compartments 11 is illustrated by arrows 12.

FIGS. 1 to 4 show the device, for example, from above, in such a manner, that the direction FQ of transverse conveyance and the direction FP of parallel conveyance are situated in a horizontal plane and encompass an angle of 90°. If the device according to the invention is oriented in this manner, the conveying compartments 11 of the transverse conveyor may be open on top and on both sides, in particular if the handled articles are relatively heavy and are held in the compartments by gravity. The auxiliary conveying means may comprise one slider in each one of the compartments.

The mentioned device orientation, however, is not a prerequisite for the method in accordance with the invention. FIGS. 1 to 4, for example, may also be understood as side views, wherein the direction FQ of transverse conveyance runs vertically and the direction FP of parallel conveyance runs horizontally. In this case, the sides of the conveying compartments 11 directed towards the viewer may need to be equipped with suitable means for keeping the articles in the compartments. It is also not a prerequisite for the method according to the invention, that the angle between the direction FQ of transverse conveyance and the direction FP of parallel conveyance is a right angle. If this angle should differ from 90° the compartments 11 need to be arranged relative to the direction of transverse conveyance such that the conveying direction of the auxiliary conveying means is still parallel to the direction of parallel conveyance.

FIGS. 1 to 4 illustrate the stream conversion according to the invention essentially on the basis of the transfer of article 5, which is supplied in the conveying compartment 11.1 of the transverse conveyor and is delivered to the parallel conveyor by the alignment means 3.

In FIG. 1, the conveying compartment 11.1 containing article 5 is approaching alignment with the entrance 21 of the parallel conveyor 2 and an edge 5.1 of article 5 which is the leading edge in the direction FP of parallel conveyance has left the conveying compartment 11.1 and, driven by the auxiliary conveying means is already moving into the action range of the alignment means 3. The accelerating effect of the auxiliary conveying means is visible from the positions of the articles in compartments 11.2 to 11.4 upstream of compartment 11.1.

Figure 2:
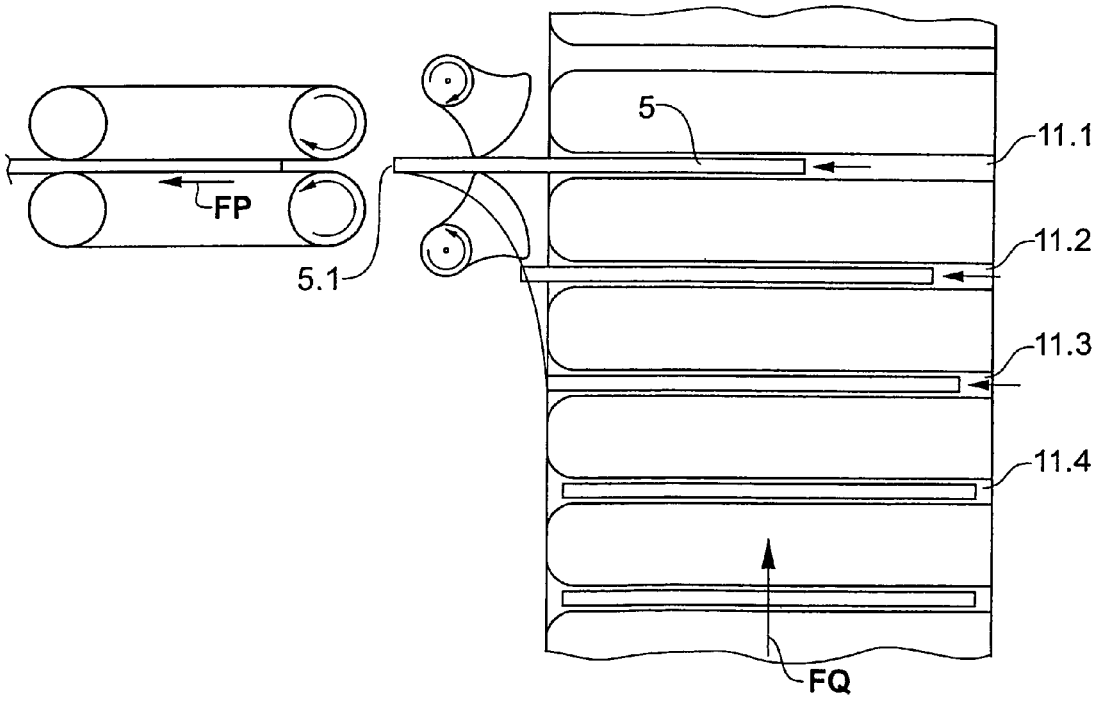

FIG. 2 illustrates the moment, in which outlet 13 of compartment 11.1 is precisely aligned to the entrance 21 of the parallel conveyor. At this moment the article has a speed corresponding to the speed of parallel conveyance and the alignment means starts to act on article 5 by gripping it in a clamping manner between the leading ends of the roller zones of constant maximum radius. From this moment, the leading edge of article 5 is precisely aligned to the entrance 21 of the parallel conveyor 2 and is guided into it by alignment means 3. After this moment, the trailing zone of article 5 is bent by the relative movement of compartment 11.1 and alignment means 3.

Figure 3:
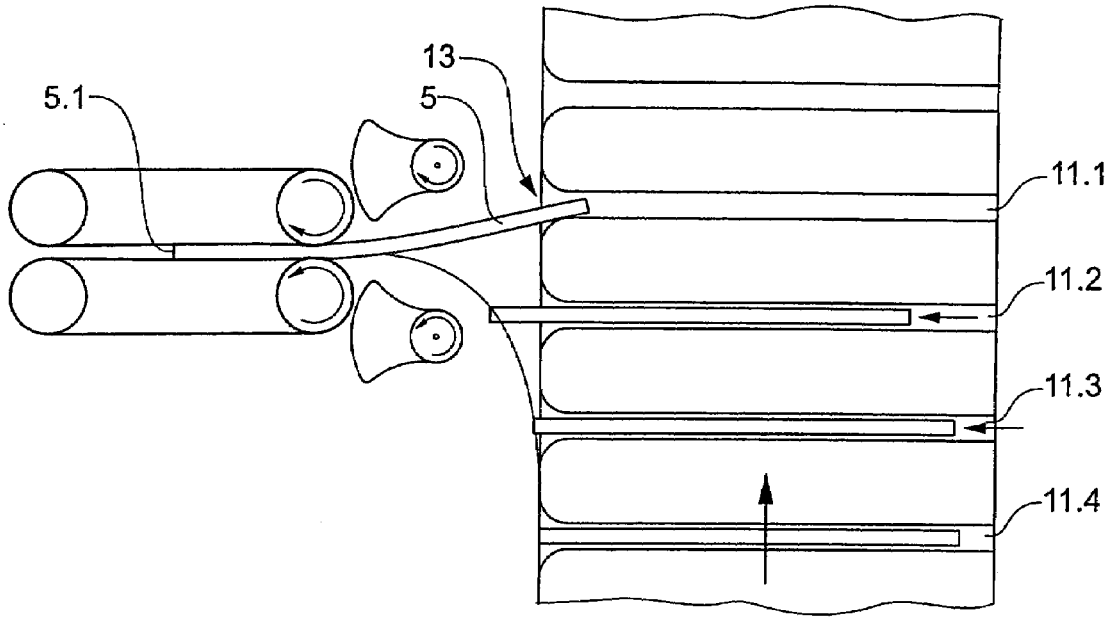

FIG. 3 shows article 5 at a moment, at which its leading edge 5.1 is already held gripped in the parallel conveyor 2, at which the effect of the alignment means 3 on the article 5 has ended but at which article 5 is still bent, namely between the entrance 21 of parallel conveyor 2 and the outlet 13 of compartment 11.1.

Figure 4:
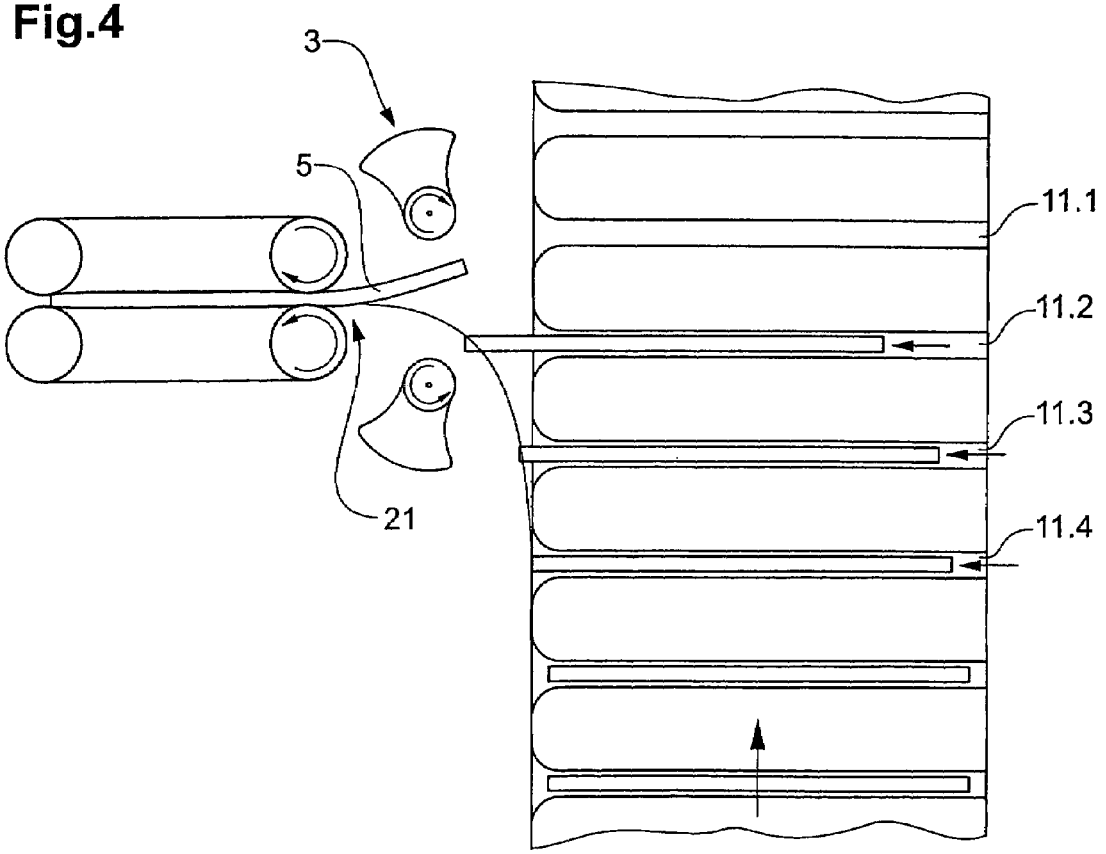

FIG. 4 finally illustrates how article 5 disappears in to entrance 21 of the parallel conveyor 2 and how a further article supplied in the next compartment 11.2 is moved in to the action range of the alignment means 3 by the auxiliary conveying means.

From FIGS. 1 to 4 it is evident, that it is readily possible to supply two or more than two parallel conveyors with articles using one only transverse conveyor 1. For such purpose, the entrances of the parallel conveyors 2 have to be aligned to one another in parallel, for example at a distance, which corresponds to a whole multiple of the distance between compartments. The auxiliary conveying means of groups of compartments 11 are then controlled in synchronism, every compartment of a group being assigned to one of the parallel conveyors.

FIGS. 5 to 8 illustrate a stream conversion from parallel conveyance to transverse conveyance, using substantially the same device and the same method as shown in FIGS. 1 to 4. The conveying directions FQ and FP and therewith the conveying direction of the not shown auxiliary conveying means (arrows 12) point in opposite directions compared with FIGS. 1 to 4 and the alignment rollers 31 and 32 rotate in the opposite direction. The auxiliary conveying means are e.g. designed as grippers being movable within the compartments 11 and gripping the articles by their inner edge (see also FIG. 12). The alignment means 3 is aligned to the entrance 13' of the conveying compartment 11.1, by which the article currently to be transferred is to be taken over, i.e., it is, at least during its acting on article 5, conveyed together with the compartment 11.1 in the direction of transverse conveyance.

Figure 5:
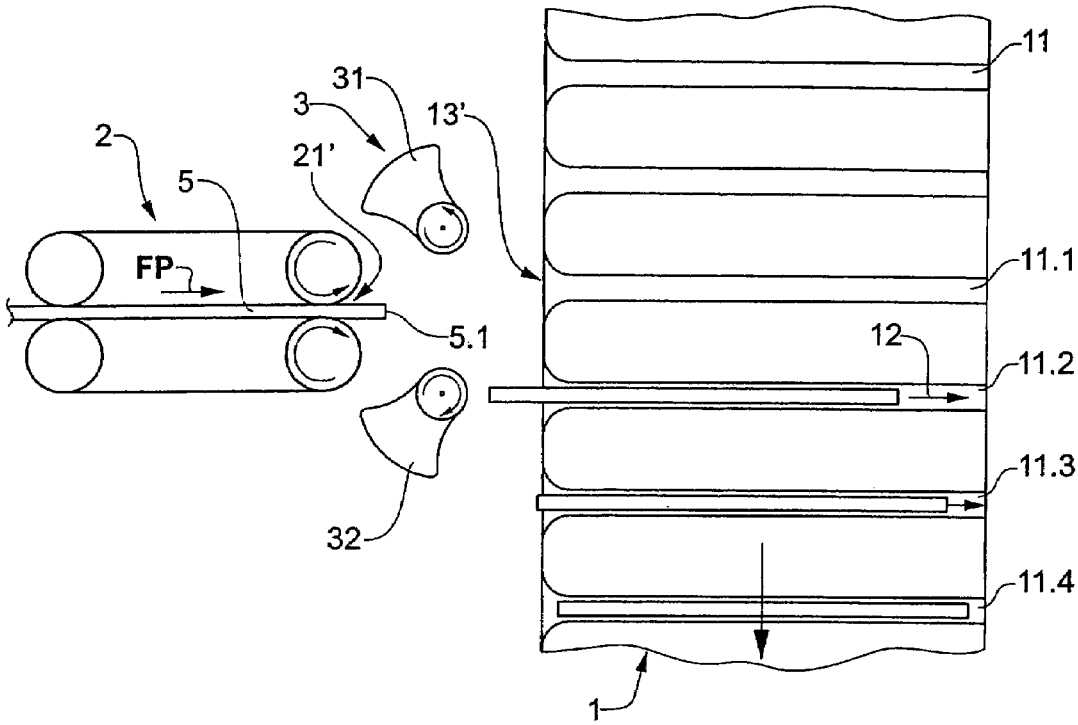
FIGS. 5 to 8 show top views of a stream conversion from parallel to transverse conveyance according the invention.
Figure 6:
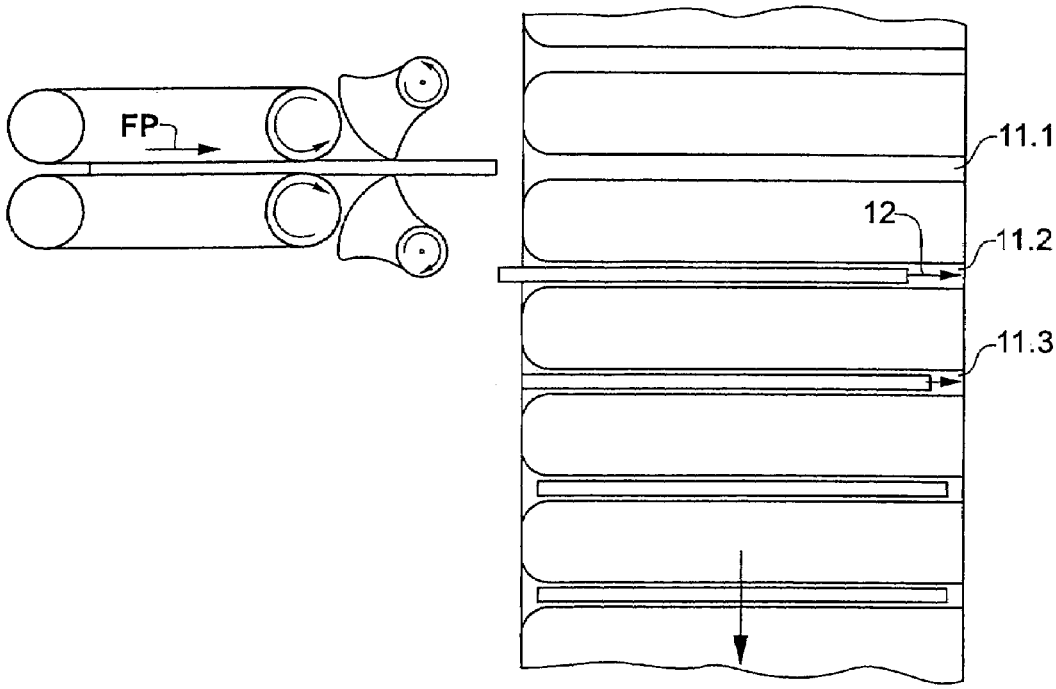
Figure 7:
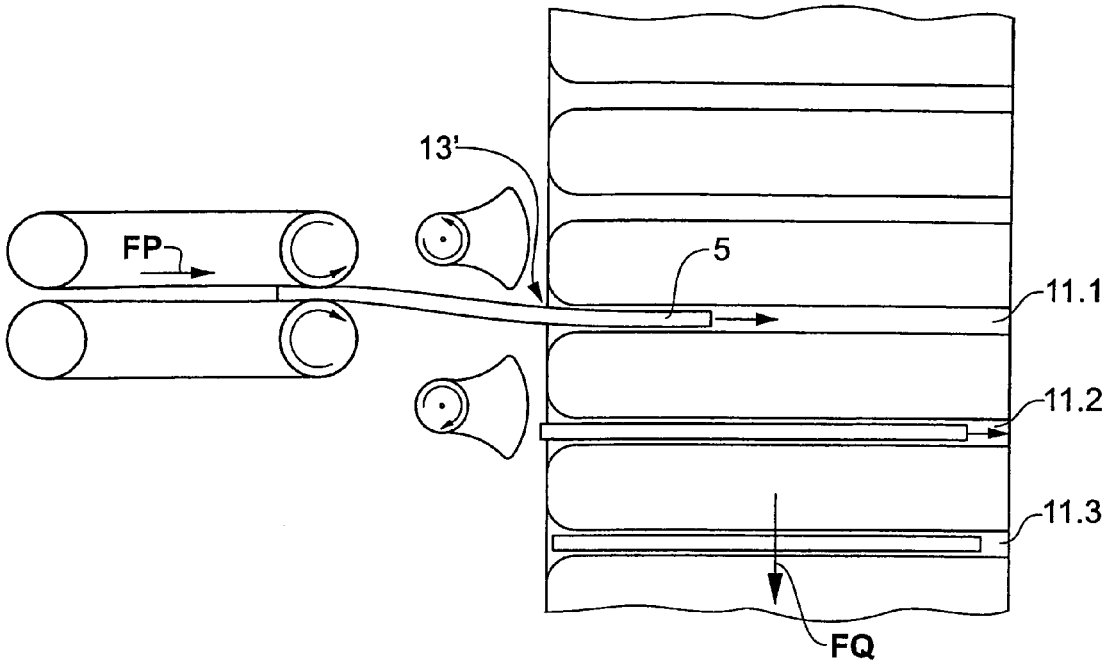
Figure 8:
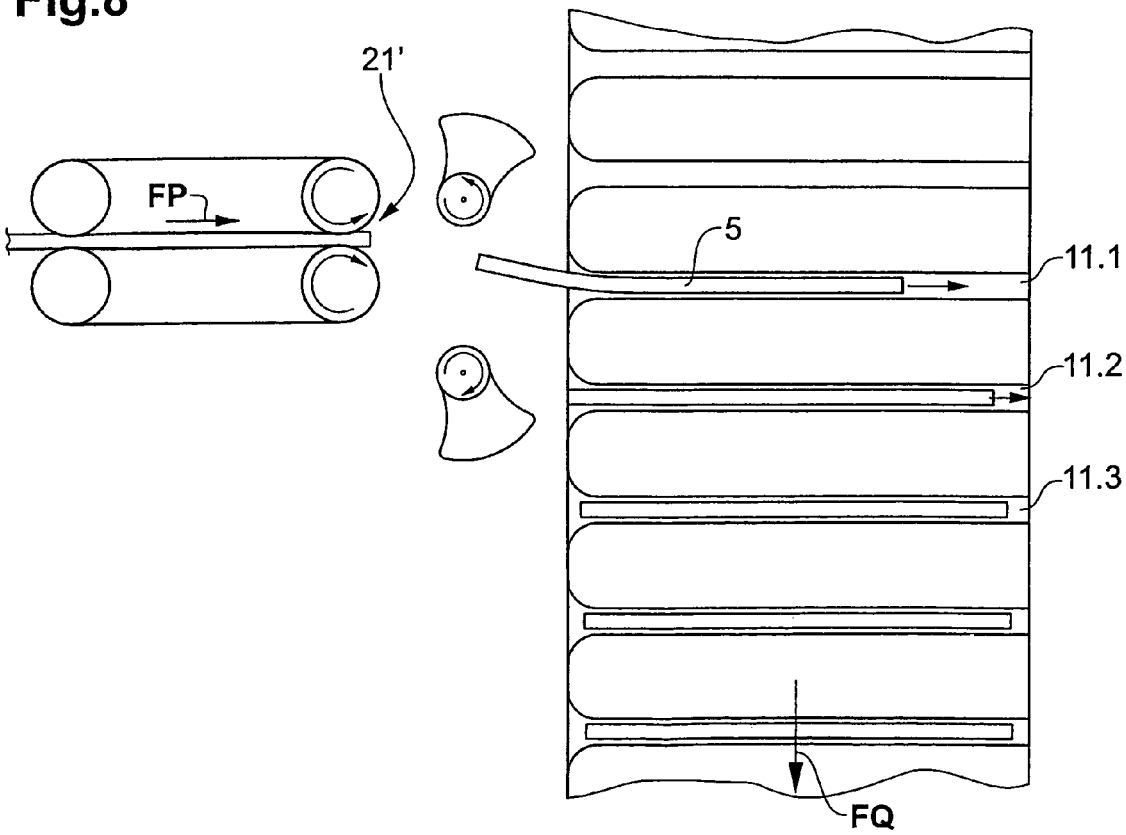

FIG. 5 shows the emergence of the leading edge 5.1 of article 5 from the outlet 21' of the parallel conveyor 2 and FIG. 6 shows the beginning of the action on the leading zone of article 5 by the alignment means 3, at the moment, in which the entrance 13' of the transverse conveyor 1 and together with it the alignment means 3 is aligned to outlet 21' of parallel conveyor 2. FIG. 7 shows the article 5 bent between the outlet 21' of parallel conveyor 2 and the entrance 13' of compartment 11.1 after the end of action by the alignment means 3. FIG. 8 illustrates the last part of the pulling-in of article 5 in to the compartment 11.1 and the emergence of a next article from the outlet 21' of parallel conveyor 2.

In the same manner as described further above for the method and the device according to the FIGS. 1 to 4, it is possible with the method and the device in accordance with FIGS. 5 to 8 also to provide more than one parallel conveyor.

Figure 9:
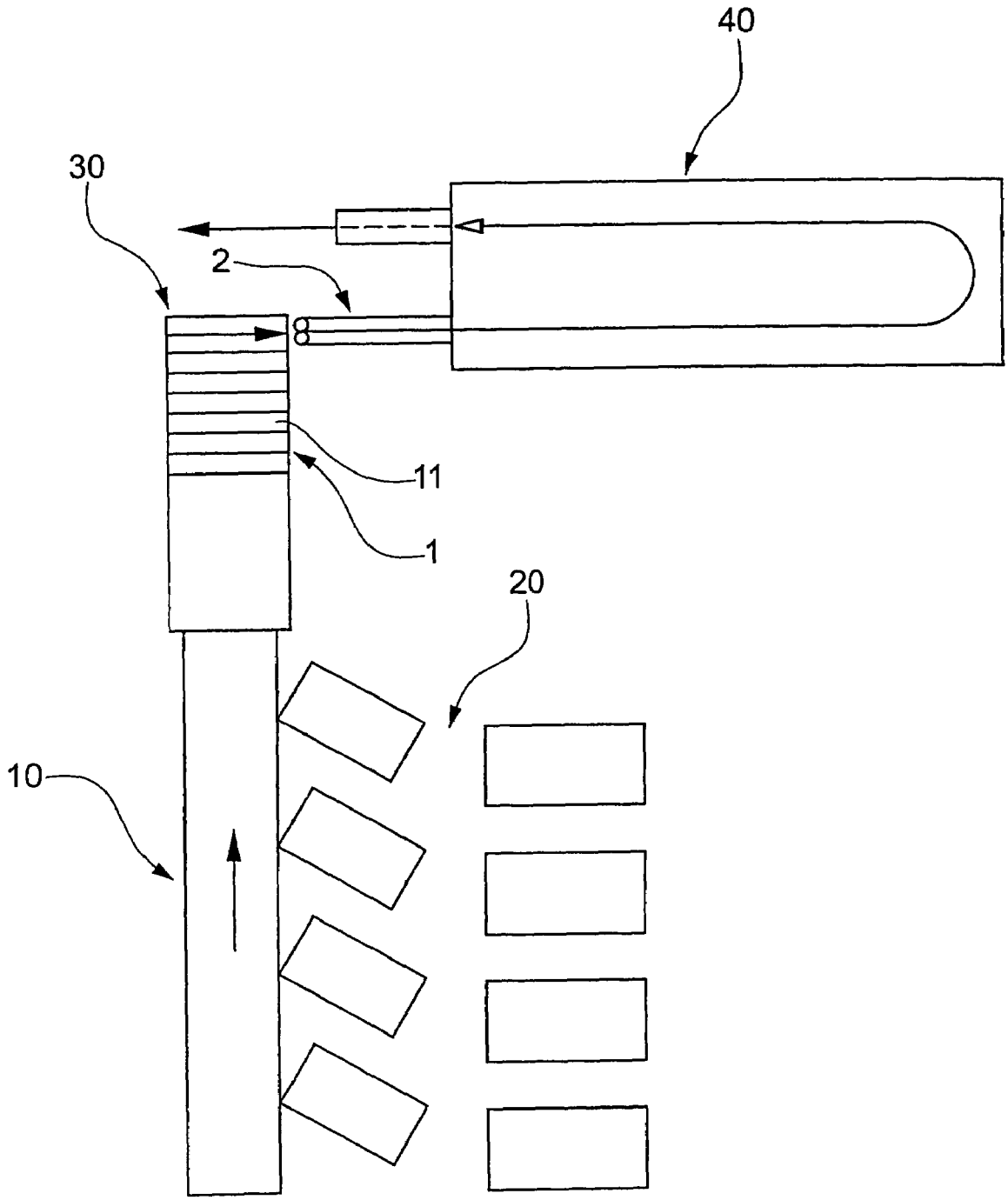
FIG. 9 shows a schematic view from above of an exemplary application of a stream conversion according to FIGS. 1 to 4 for the supply of stack-shaped groups of signatures or individual sheets to a glue-binding machine.

FIG. 9 depicts an installation comprising a device 30 in accordance with the invention, such as is illustrated, for example, in FIGS. 1 to 4. The installation serves for producing in a continuous manner (e.g., by collating) stack-shaped groups of partial products and for glue-binding the partial products of every stack. The installation is illustrated in FIG. 9 as a schematic view from above and in FIG. 10 as a three-dimensional partial view.

The installation comprises a collating stretch 10 for producing a stream of stack-shaped groups, the collating stretch comprising a plurality of feed points 20 arranged one after another, wherein at each feed point one partial product is added to each stack. The product edges to be bound are the leading edges and within every stack they are already aligned to one another as accurately as possible.

The stack-shaped groups being supplied by the collating stretch, are positioned in the compartments 11 of the transverse conveyor 1 of the device according to the invention in a per se known manner, by e.g. being pushed from a conveyor belt into the compartments 11, which being deviated have an approximately horizontal position or a position being slightly declining towards the inside. The stack-like groups may also be introduced from above into the compartments being conveyed essentially horizontally. In the compartments the stack edges to be bound are facing towards the inside, i.e. downwards. From the compartments 11, the stack-shaped groups are transferred to the parallel conveyor 2 in the manner described in conjunction with FIGS. 1 to 4, to be conveyed in to the glue-binding machine 40 and having an orientation suitable for glue-binding (edge to be bound facing downwards and being aligned in conveying direction).

During conveyance in the compartments 11, alignment of the part product edges to be bound may be improved by vibrating the compartments or the part products may be laterally aligned in any known manner. Equally during conveyance in the compartments—before they reach the entrance of the parallel conveyor—stack thickness may be measured and auxiliary conveying means in compartments containing too thin or too thick and therefore faulty stacks may not be activated such preventing faulty stacks from being conveyed in to the binding machine but being conveyed on and being e.g. during the next deviation of the conveying compartments 11 to be dropped from the compartment.

Figure 10:
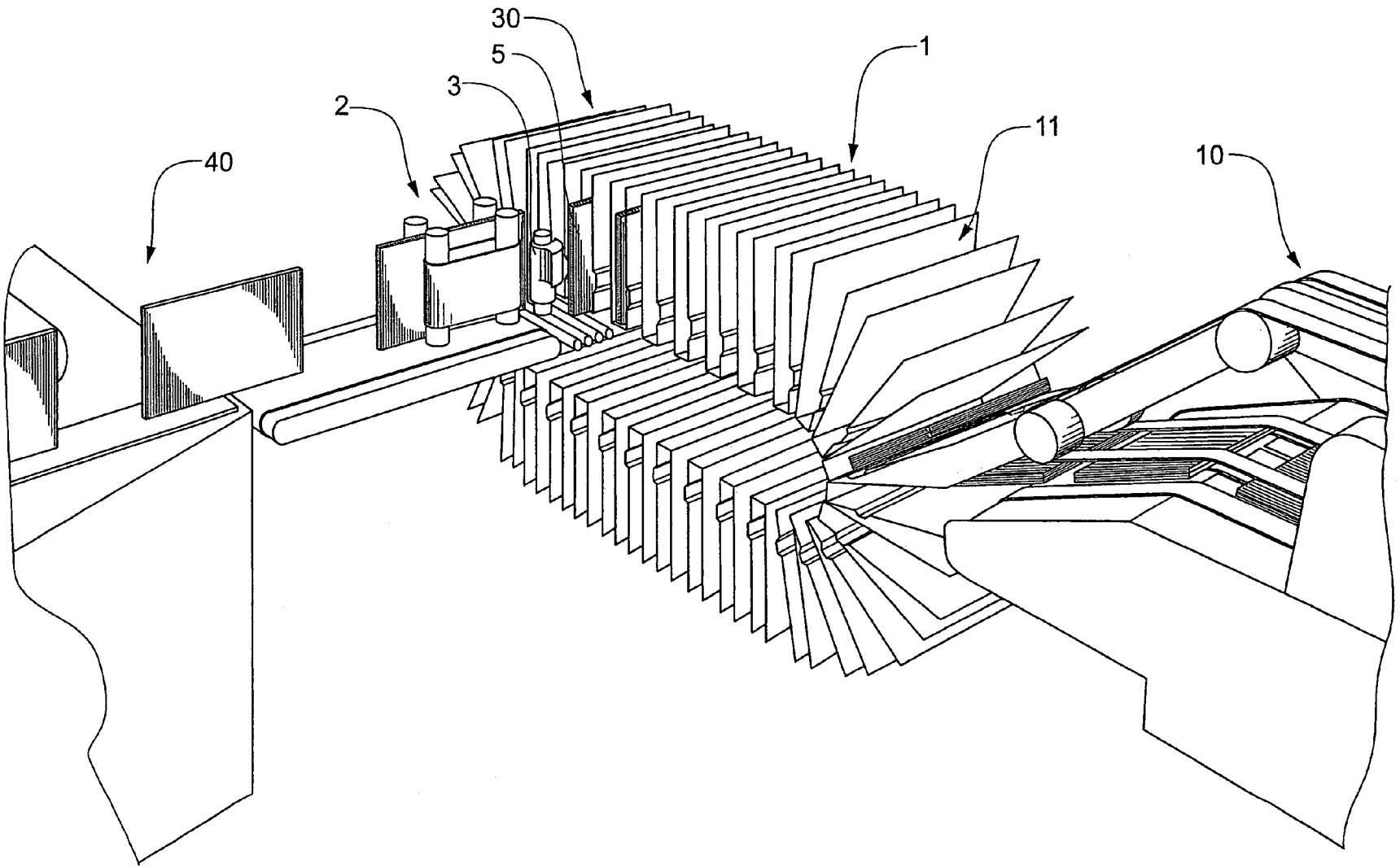
FIG. 10 shows a three dimensional partial illustration of an exemplary application of a stream conversion according to FIGS. 1 to 4 for the supply of stack-shaped groups of signatures or individual sheets to a glue-binding machine.

FIG. 10 is a three-dimensional illustration of the one part of the installation according to FIG. 9, which comprises device 30 according to the invention. Same elements are designated with same reference numbers as in previous Figs. From FIG. 10 it is evident, that the transverse conveyor 1 is designed as a circulating system with two deflection rollers. The compartments 11 protruding in radial direction, for example, are attached to two chains circulating in parallel, wherein the chains run over the deflection rollers.

For stacks having a binding edge with a length of 425 mm, as is the case for magazines, and for a compartment spacing in the transverse conveyor 1 of 8 cm, for achieving a capacity of 15,000 copies per hour, a speed of transverse conveyance of 0.34 m/s and a speed of parallel conveyance of 1.7 m/s are required. For a capacity of 18,000 copies per hours, the speeds are correspondingly 0.42 and 2.13 m/s.

It is particularly advantageous, if for producing the stack-shaped groups the method described in the patent application WO-03/053831 is used, i.e. the groups are produced not by collating, but rather by guiding imbricated streams of different part products to be superimposed. The part products in all imbricated streams are arranged in such a manner, that leading edges of the part products of each group are aligned to one another. From the leading end of the superimposed imbricated streams the groups are separated in succession by gripping the aligned part product edges and are advantageously directly transferred in to compartments 11 of the transverse conveyor 1.

Figure 11:
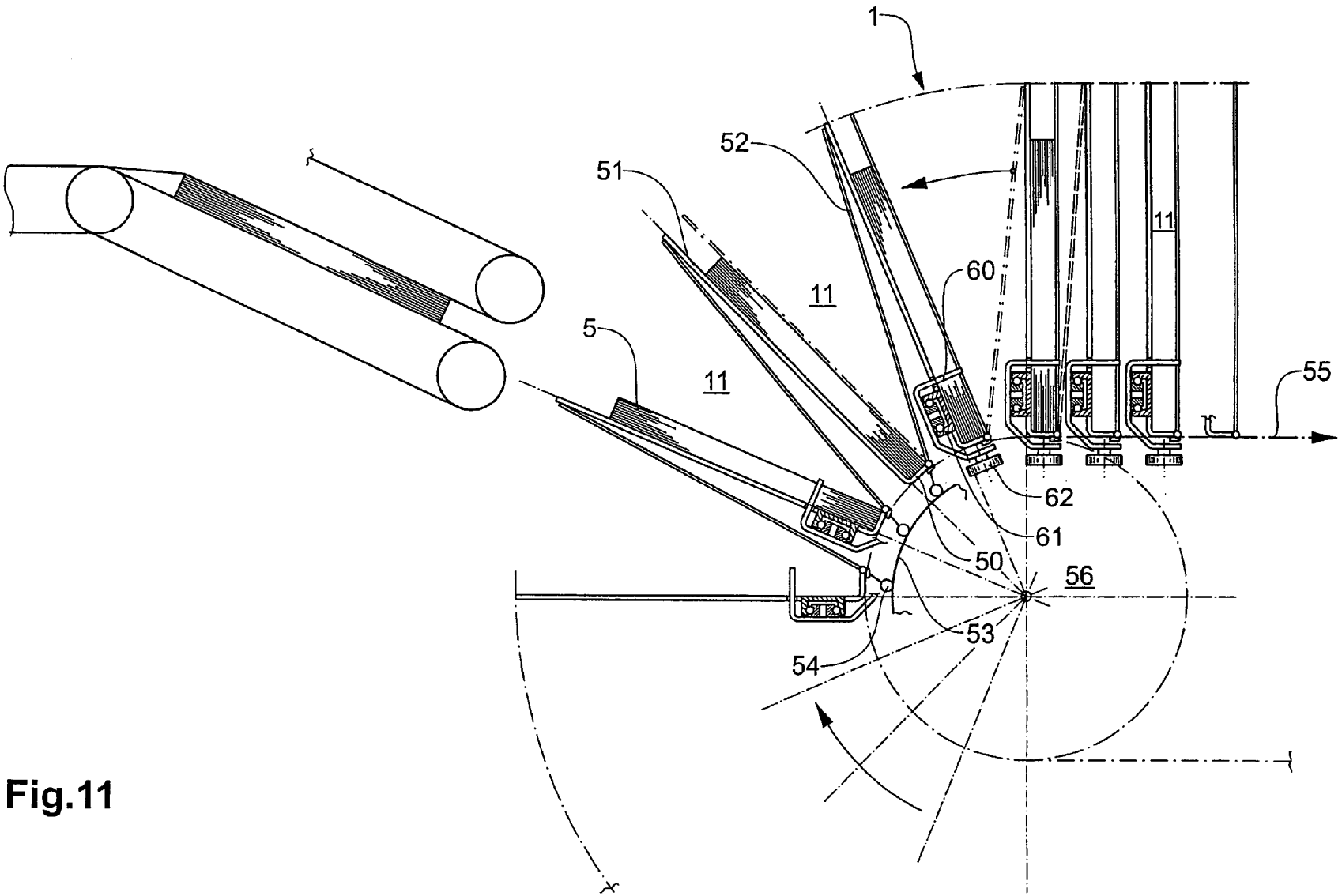
FIG. 11 shows an exemplary embodiment of transverse conveyor and auxiliary conveying means, applicable in the method according to the invention.

FIG. 11 shows in more detail an exemplary embodiment of conveying compartments 11 for a transverse conveyor 1 as shown in the preceding Figs. Each conveying compartment 11 comprises an upstream wall 51 being rigidly connected to a compartment floor 50 and a downstream wall 52 being pivotally supported in the compartment floor. The downstream wall 52 is held in a closed position by a not illustrated resetting means and it is brought into an open position controlled, for example, by a cam 53, on which a control roller 54 arranged at the lower end of the downstream wall 52 rolls. The compartments are arranged on a circulating conveying organ, e.g., chains (dot-dash line 55), in such a manner that they follow one behind the other as closely as possible when being conveyed along a straight path and that they are capable of being opened sufficiently for introduction of the flat articles 5 or of the stack-shaped groups of part products in the area of the deflection wheel 56.

FIG. 11 shows an auxiliary conveying means in the form of a slider 60 being provided in each one of the compartments 11. The slider 60 protrudes in to the compartment 11 through a corresponding slit in the upstream wall 51 and is supported outside of the upstream wall 51 by a longitudinal guide system 61. The slider movement parallel to the axis of the deflection wheel 56 is controlled by a cam (not shown), on which control rollers 62 installed on the slider roll.

For an adjustment of the compartments 11 to the thickness of the articles 5 or the stacks to be processed, it is advantageous to design the pivoting support of the downstream walls 52 to be displaceable in such a manner, that the width of the compartment floor 50 becomes adjustable.

It is also possible to provide an external slider or an arrangement of a plurality of external sliders instead of the sliders according to FIG. 11 which are arranged within every compartment 11 and to move the external slider into the compartments in a direction oblique to the direction of transverse conveyance. Such auxiliary conveying means is, for example, described in the publication U.S. Pat. No. 1,760,030 mentioned further above.

Figure 12:
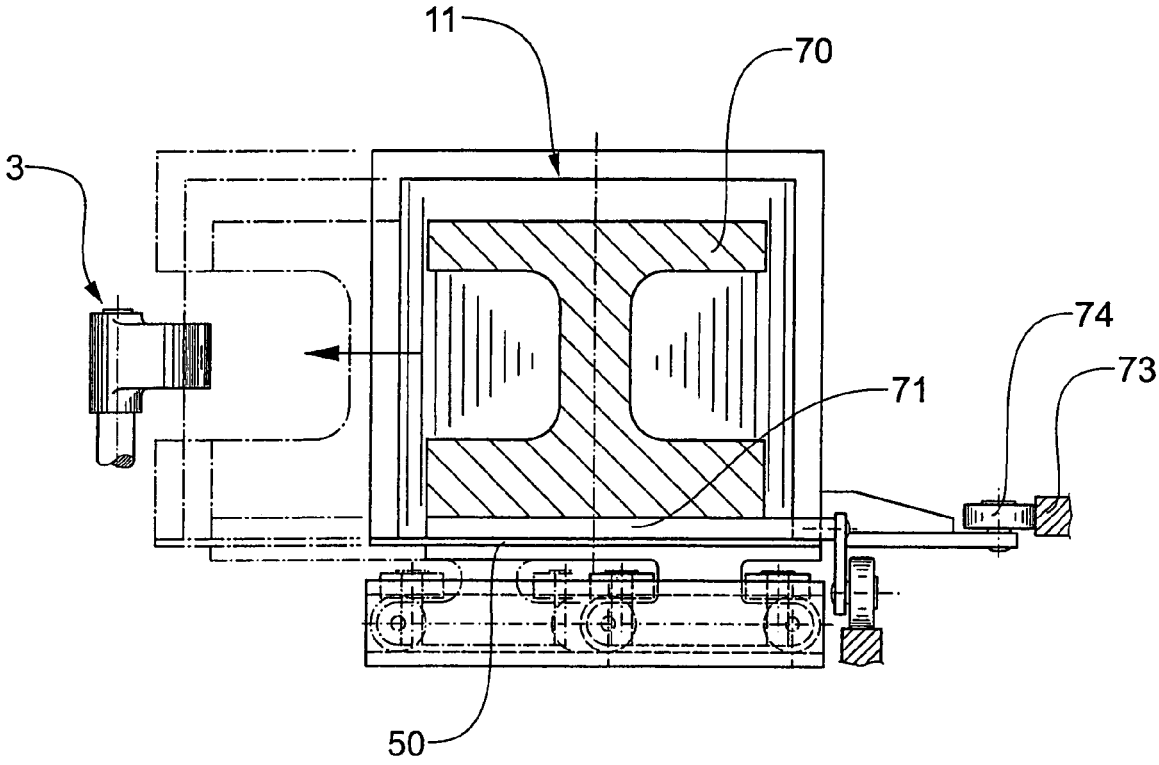
FIG. 12 shows a further, exemplary embodiment of an auxiliary conveying means for a transverse conveyor comprising conveying compartments.

FIG. 12 illustrates a further, exemplary embodiment of an auxiliary conveying means for a conveying compartment 11 of a transverse conveyor in accordance with the invention. The conveying compartment 11 which has no upstream wall is viewed perpendicular to the direction of transverse conveyance. The auxiliary conveying means comprises two jaw-like clamping parts 70 (one of them visible) being mounted on a slide 71 and being movable against each other and away from each other. Slide 71 is arranged near the compartment floor 50 and is displaceable transverse to the direction of transverse conveyance. The slide movement is controlled, for example, by a cam 73, on which a control roller 74 arranged on a slide part protruding from the compartment 11 rolls.

The invention claimed is:

1. A method for converting a stream of flat articles (5) from one of transverse conveyance and parallel conveyance to the other of parallel conveyance and transverse conveyance, the method comprising the steps of:

providing two continuously operated conveyors (1 and 2), one of which being a transverse conveyor (1) with a direction (FQ) of transverse conveyance and the other one being a parallel conveyor (2) with a direction (FP) of parallel conveyance, wherein one of the conveyors (1 and 2) is a supplying conveyor for supplying the articles (5) and the other one is is a removing conveyor for removing the articles (5) and wherein the direction (FQ) of transverse conveyance and the direction (FP) of parallel conveyance encompass an angle, providing an alignment means, providing an auxiliary conveying means for displacing articles being conveyed by the transverse conveyor transverse to the direction of transverse conveyance, (3), pushing the articles (5), one after the other, out of an outlet (13, 21') of the supplying conveyor towards an entrance (21, 13') of the removing conveyor, grasping a leading zone of the article with the alignment means (3) and thereby aligning the article with the entrance (21, 13') of the removing conveyor, before a trailing zone of the article (5) has left the supplying conveyor, and conveying the article onwards in the direction (FP) of parallel conveyance at a speed of the parallel conveyor (2), while bending a trailing zone of the article between the alignment means (3) and the outlet (13, 21') of the supplying conveyor wherein the step of pushing is executed by the auxiliary conveyor if the transverse conveyor is the supplying conveyor, and wherein the step of conveying the article onwards is executed by the auxiliary conveyor if the transverse conveyor is the removing conveyor.

2. The method according to claim 1, wherein the transverse conveyor (1) supplies the articles (5) and comprises a plurality of outlets (13) moving in the direction (FQ) of transverse conveyance, wherein the parallel conveyor (2) removes the articles (5) and comprises a stationary entrance (21), and wherein the alignment means (3) is stationary and aligned with the entrance (21) of the parallel conveyor (2).

3. The method according to claim 1, wherein the parallel conveyor (2) supplies the articles (5) and comprises a stationary outlet (21'), wherein the transverse conveyor (1) removes the articles (5) and comprises a plurality of entrances (13') moving in the direction (FQ) of transverse conveyance, and wherein the alignment means (3) moves in the direction (FQ) of transverse conveyance, in order to remain aligned to one of the entrances (13') of the transverse conveyor (1).

4. The method according to one claim 1, wherein a plurality of parallel conveyors (2) is provided, and wherein entrances (21) or outlets (21'), respectively, of said plurality of parallel conveyors being aligned in parallel.

5. A device for converting a stream of flat articles (5) from one of transverse conveyance and parallel conveyance to the other of transverse and parallel conveyance, the device comprising:

two continuously operated conveyors (1 and 2), of which one is a transverse conveyor (1) with a direction (FQ) of transverse conveyance and the other is a parallel conveyor (2) with a direction (FP) of parallel conveyance, wherein the direction (FQ) of transverse conveyance and the direction (FP) of parallel conveyance are oriented such that one of the conveyors supplies the articles (5) and comprises at least one outlet (13, 21') and the other removes the articles (5) and comprises at least one entrance (21, 13') and wherein the two directions of conveyance (FQ and FP) encompass an angle, and alignment means (3) arranged between the transverse conveyor (1) and the parallel conveyor (2), wherein the transverse conveyor (1) comprises an auxiliary conveying means, which is equipped for displacing conveyed articles (5) transverse to the direction (FQ) of transverse conveyance, and wherein the alignment means is adapted to grasp a leading zone of each article (5) pushed out of the outlet (13, 21')

of the supplying conveyor, to move the article in the direction (FP) of parallel conveyance, and thereby hold the article's leading zone aligned with the entrance (21, 13') of the removing conveyor, and to bend a trailing zone between the outlet (13, 21') of the supplying conveyor and the alignment means.

6. The device according to claim 5, wherein the alignment means (3) is either stationary and aligned to the entrance (21) of the parallel conveyor (2) being the removing conveyor or is driven in the direction (FQ) of transverse conveyance, in order to remain aligned with one entrance (13') of a plurality of entrances (13') of the transverse conveyor (1) being the removing conveyor.

7. The device according to claim 5, wherein the alignment means (3) comprises two alignment rollers (31, 32) being driven to rotate in opposite directions around axes arranged in parallel and transverse to the direction (FP) of parallel conveyance, and wherein the circumference of the alignment rollers comprises a part of a constant maximum radius and a part of a radius smaller than the maximum radius.

8. The device according to claim 5, wherein the transverse conveyor (1) comprises circulating conveying compartments (11) extending transverse to the direction (FQ) of transverse conveyance, each conveying compartment comprising, on one side, an outlet (13) or an inlet (13').

9. The device according to claim 8, wherein each conveying compartment (11) is equipped with an auxiliary conveying means.

10. The device according to claim 9, wherein the auxiliary conveying means comprises one of a slider (60) and clamping elements (70) mounted on a displaceable slide (71).

11. The device according to claim 8, wherein each conveying compartment (11) comprises an upstream wall (51) that is rigidly connected with a compartment floor (50) and a downstream wall (52) that is pivotable relative to the compartment floor.

12. The device according to claim 11, wherein a support of the downstream wall (52) is displaceable in the direction (FQ) of transverse conveyance.

13. The device according to claim 5, wherein the angle between the direction (FQ) of transverse conveyance and the direction (FP) of parallel conveyance amounts to 90°.

14. The device according to claim 5, comprising more than one parallel conveyor (2).

* * * * *